US008157196B2

(12) United States Patent
Hao

(10) Patent No.: US 8,157,196 B2
(45) Date of Patent: Apr. 17, 2012

(54) GRINDING DEVICE OF VERTICAL GRINDER

(76) Inventor: Zhigang Hao, Changsha (CN)

( * ) Notice: Subject to any disclaimer, the term of this patent is extended or adjusted under 35 U.S.C. 154(b) by 0 days.

(21) Appl. No.: 12/809,543

(22) PCT Filed: Nov. 14, 2008

(86) PCT No.: PCT/CN2008/073076

§ 371 (c)(1),
(2), (4) Date: Jun. 18, 2010

(87) PCT Pub. No.: WO2009/067936

PCT Pub. Date: Jun. 4, 2009

(65) Prior Publication Data

US 2010/0288865 A1 Nov. 18, 2010

(30) Foreign Application Priority Data

Nov. 20, 2007 (CN) ..... 2007 1 0036167

(51) Int. Cl.
*B02C 15/00* (2006.01)

(52) U.S. Cl. ..... 241/121

(58) Field of Classification Search ..... 241/117–121
See application file for complete search history.

(56) References Cited

U.S. PATENT DOCUMENTS

| | | | | | |
|---|---|---|---|---|---|
| 2,677,533 | A * | 5/1954 | McMurray | 366/285 |
| 2,818,219 | A * | 12/1957 | Straight | 241/119 |
| 4,489,895 | A * | 12/1984 | Petersen | 241/19 |
| 4,606,506 | A | 8/1986 | Okada et al. | |
| 4,798,344 | A * | 1/1989 | Fishburn | 241/79.1 |
| 6,079,648 | A * | 6/2000 | Eastman et al. | 241/119 |
| 7,448,565 | B2 * | 11/2008 | Farris | 241/119 |

FOREIGN PATENT DOCUMENTS

| | | | |
|---|---|---|---|
| CN | 1345633 | A | 4/2002 |
| CN | 2680354 | Y | 2/2005 |
| CN | 1792460 | A | 6/2006 |
| CN | 101161346 | A | 4/2008 |
| CN | 201124105 | Y | 10/2008 |

* cited by examiner

*Primary Examiner* — Mark Rosenbaum
(74) *Attorney, Agent, or Firm* — Schwabe, Williamson & Wyatt, P.C.

(57) ABSTRACT

A grinding device of vertical grinder, comprising a driving device (1); a vertical grinding barrel (2) which is driven by the driving device; a grinding roller (3); and a pressure applying device (4) acting on the grinding roller (3); a running-in surface is composed of the roller surface of the grinding roller and the grinding surface (6) of the inner lining of the vertical grinding barrel, and the angular separation between the grinding surface (6) of the inner lining of the vertical grinding barrel and the vertical line is 40 degrees to −5 degrees. The device is also provided with a material-shaving device (9).

4 Claims, 3 Drawing Sheets

GRINDING DEVICE OF VERTICAL GRINDER

RELATED APPLICATION

This application claims the benefit of PCT Application PCT/CN2008/073076 filed Nov. 14, 2008, which in turn claims the benefit of Chinese Patent Application No. 200710036167.3 filed Nov. 20, 2007.

FIELD OF THE INVENTION

The present invention relates to a material crushing device, and particularly, to improvement of a grinding device of a vertical grinder.

BACKGROUND OF THE INVENTION

The *China Ore-Dressing Equipment Manual* published by the Science Press in 2006 describes a vertical grinder in page 407, and a grinding device of the vertical grinder is illustrated in FIG. 1, including a driving device 1'; a vertical grinding barrel 2' which is driven by the driving device; a grinding roller 3'; and a pressure applying device 4' acting on the grinding roller 3'; wherein the vertical grinding barrel 2' is located in a body casing 5'; and a running-in surface is composed of the roller surface of the grinding roller and the grinding surface 6' of the inner lining of the vertical grinding barrel. Materials enter the vertical grinding barrel through a material inlet 7'. The driving device drives the vertical grinding barrel to rotate, and the grinding roller rotates therewith, so as to grind the materials entering the running-in surface. The grinded materials are thrown off the vertical grinding barrel under the centrifugal force caused by the rotation of the vertical grinding barrel 2'. The fine-particles of the grinded materials are discharged with an airflow rising from the lower portion, and uncrushable materials such as tramp iron is discharged from a slag outlet 8' at the lower portion of the body casing. The grinding device has the following disadvantages: since the vertical grinding barrel 2' is of a bowl-shaped structure and the grinding surface 6' of the inner lining of the grinding barrel forms a large angle with the vertical line (i.e., the grinding surface 6' is relatively horizontal), the grinded materials are thrown off the grinding barrel under the centrifugal force at a fast speed and cannot be controlled, and thus they are being freely discharged; particularly, when the vertical grinding barrel 2' rotates at a high speed, a large centrifugal force is generated, the materials stay on the running-in surface only for a short time, and the times of crushing and grinding the materials are reduced; therefore, the grinding production efficiency is low and the energy consumption is high; when the grinded materials contain too much moisture, the materials may be attached to the vertical grinding barrel and form a massive layer due to absence of a material-shaving device, which further affects the yield.

SUMMARY OF THE INVENTION

In order to overcome the disadvantages of the prior art grinding device, the present invention provides a grinding device of a vertical grinder, which is capable of increasing opportunities and times of materials being grinded, so as to improve the grinding efficiency and reduce the energy consumption.

Referring to FIG. 2 for the technical solution that achieves the object of the present invention, the present invention includes a driving device 1; a vertical grinding barrel 2 which is driven by the driving device; a grinding roller 3; and a pressure applying device 4 acting on the grinding roller 3; wherein a running-in surface is composed of the roller surface of the grinding roller and the grinding surface 6 of the inner lining of the vertical grinding barrel; an angular separation between the grinding surface 6 of the inner lining of the vertical grinding barrel and the vertical line is 40 degrees to −5 degrees; and a material-shaving device 9 is also provided therein. As illustrated in FIG. 2, the materials enter the vertical grinding barrel through a material inlet 7; the driving device drives the vertical grinding barrel to rotate, and the grinding roller rotates therewith, so as to grind the materials entering the running-in surface; the material-shaving device 9 loosens and guides the grinded materials; under the centrifugal force of the rotation of the grinding barrel and the guidance, the grinded materials are discharged from an upper opening of the vertical grinding barrel, and discharged off the machine from a material outlet 10.

As compared with the prior art, the present invention has the following technical effects:

1. Since the angular separation between the grinding surface 6 of the inner lining of the grinding barrel and the vertical line is 40 degrees to −5 degrees, the grinded materials can be prevented from being discharged rapidly from the grinding barrel, so that the materials are closely attached to the inner wall of the grinding barrel under the centrifugal force, thus the process of material grinding process is prolonged and the times of material grinding are increased, thereby resulting in a high efficiency of material crushing and grinding, a large yield, a good fineness and a reduced power consumption.
2. Since the angular separation between the grinding surface 6 of the inner lining of the grinding barrel and the vertical line is 40 degrees to −5 degrees, the grinded materials can be prevented from being discharged rapidly from the grinding barrel, and thus the vertical grinding barrel can rotate in a high speed, which achieves a higher efficiency of material crushing and grinding, a better fineness, a larger yield and a lower power consumption.
3. Since the material-shaving device 9 is provided for loosening and guiding the grinded materials, in case that the angular separation between the grinding surface 6 of the inner lining of the grinding barrel and the vertical line is 40 degrees to −5 degrees, the grinded materials can be compulsively loosened and discharged so that the materials are discharged from the upper opening of the vertical grinding barrel, and thus the range of the materials, which can be grinded by the vertical grinding barrel, is expanded, and materials, which cannot or are difficult to be crushed and grinded in the prior art, can also be crushed and grinded, e.g., viscous materials or those containing too much moisture can be crushed and grinded, and wet grinding (e.g., materials are grinded by adding water thereto) can be performed.
4. Since the material-shaving device 9 is provided for loosening and guiding the grinded materials, the grinded materials can be prevented from being attached to the vertical grinding barrel and forming a massive layer, and vibrations generated during operation of the grinder can also be reduced.

The present invention is further described as follows in conjunction with the drawings and the embodiments.

DETAILED DESCRIPTION OF THE EMBODIMENTS

Figure 1:
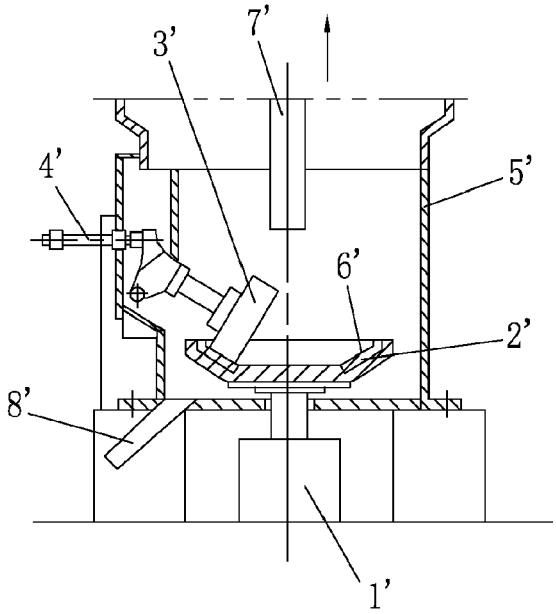
FIG. 1 is a sectional view illustrating a structure of a grinding device in the prior art.
Figure 2:
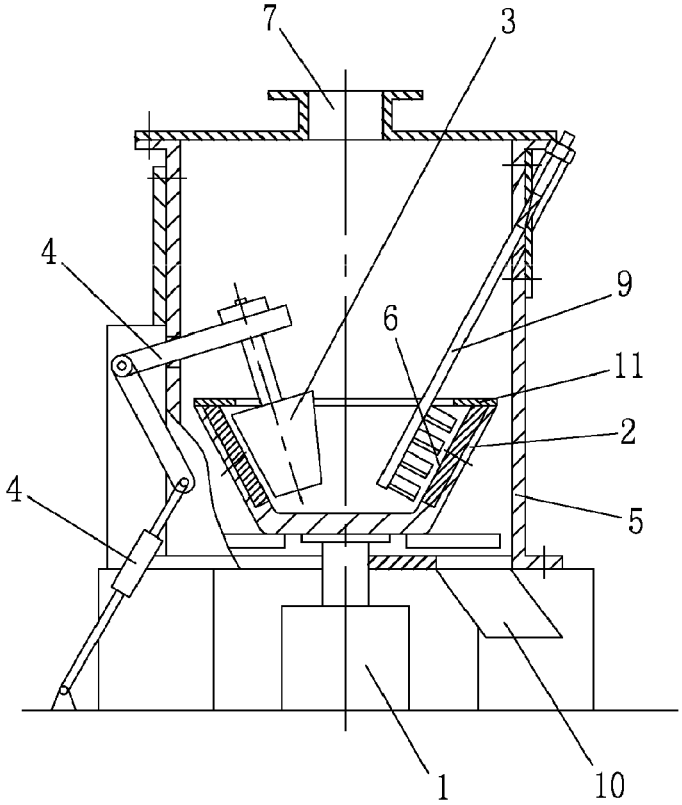
FIG. 2 is a sectional view of a first example structure of a grinding device of the invention, which is selected as the drawing for the Abstract.

Referring to FIG. 2 for a first example structure of a grinding device of the present invention, the present invention includes a driving device 1; a vertical grinding barrel 2 which is driven by the driving device; a grinding roller 3; and a pressure applying device 4 acting on the grinding roller 3. A running-in surface is composed of the roller surface of the grinding roller and the grinding surface 6 of the inner lining of the vertical grinding barrel. The vertical grinding barrel has an enclosed bottom and an opening top. An angular separation between the grinding surface 6 of the inner lining of the vertical grinding barrel and the vertical line is 40 degrees to −5 degrees. A material-shaving device 9 is also provided in the grinding device. Due to the angular separation of 40 degrees to −5 degrees between the grinding surface 6 of the inner lining of the vertical grinding barrel and the vertical line, the discharge of materials off the vertical grinding barrel is controllable, so that the materials are closely attached to the inner wall of the vertical grinding barrel under the centrifugal force caused by the rotation of the vertical grinding barrel, and thus the material grinding process is prolonged and the times of material grinding are increased. One end of the material-shaving device 9 is mounted on a side or top of a body casing 5, or mounted on another frame outside the body casing 5, and the other end of the material-shaving device 9, i.e., a material-shaving end, is extended into the vertical grinding barrel 2, so that the material-shaving device 9 can loosen and guide the grinded materials closely attached to the inner wall of the vertical grinding barrel, and drive the grinded materials to flow toward the upper opening of the vertical grinding barrel until they are discharged off the vertical grinding barrel. In addition, the edge of the opening of the vertical grinding barrel 2 is provided with a blocking ring 11. As shown in FIG. 2, the blocking ring 11 is a disc-shaped blocking ring 11 for further preventing the grinded materials from being freely discharged, so that the vertical grinding barrel can rotate in a high speed, thereby resulting in a higher efficiency of material crushing and grinding, a better fineness, a larger yield and lower power consumption.

Figure 3:
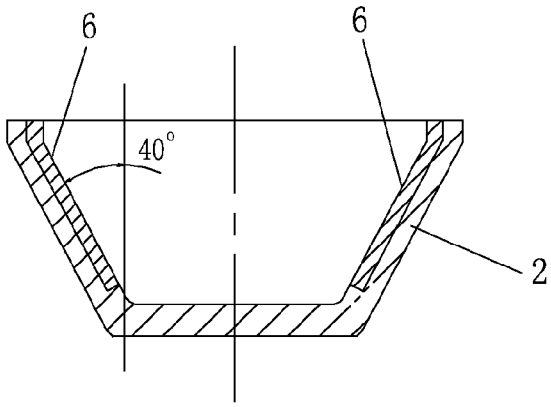
FIG. 3 is a first structural diagram of a vertical grinding barrel of the invention.
Figure 4:
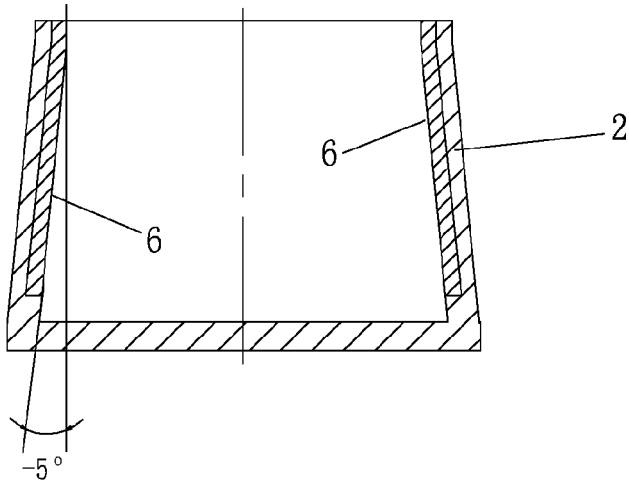
FIG. 4 is a second structural diagram of a vertical grinding barrel of the invention.
Figure 5:
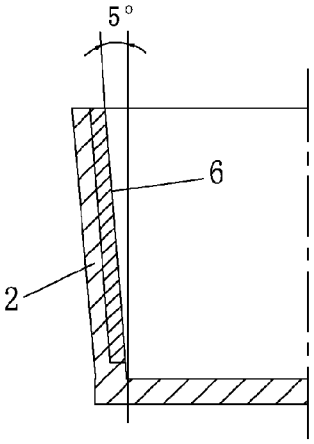
FIG. 5 is a third structural diagram of a vertical grinding barrel of the invention.

FIGS. 3~5 respectively illustrate three angular separations between the grinding surface 6 of the inner lining of the vertical grinding barrel and the vertical line. FIG. 3 illustrates an angular separation of 40 degrees between the grinding surface 6 of the inner lining of the vertical grinding barrel and the vertical line, FIG. 4 illustrates an angular separation of −5 degrees between the grinding surface 6 of the inner lining of the vertical grinding barrel and the vertical line, and FIG. 5 illustrates an angular separation of 5 degrees between the grinding surface 6 of the inner lining of the vertical grinding barrel and the vertical line.

Figure 6:
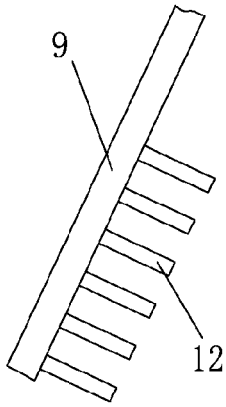
FIG. 6 is a first structural diagram of a material-shaving device of the invention.
Figure 7:
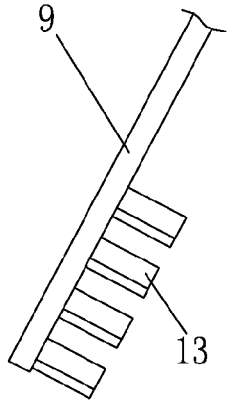
FIG. 7 is a second structural diagram of a material-shaving device of the invention.

FIGS. 6~7 illustrate two structures of the material-shaving device 9. FIG. 6 illustrates a material-shaving device having a comb-like shape 12, and FIG. 7 illustrates a material-shaving device having guiding plates 13. The material-shaving device having the comb-like shape 12 is suitable for the vertical grinding barrel 2 of 5 to 40 degrees (excluding 5 degrees per se), and it loosens the grinded materials so that they are discharged from the upper opening of the rotating vertical grinding barrel. The material-shaving device having the guiding plates 13 is suitable for the vertical grinding barrel 2 of −5 to 5 degrees, which can compulsively loosen and discharge the grinded materials to drive the grinded materials to flow toward the opening of the vertical grinding barrel. The material-shaving device 9 having the guiding plates 13 is also suitable for the case that an angular separation between the grinding surface 6 of the inner lining of the vertical grinding barrel and the vertical line is larger than 5 to 40 degrees.

Figure 8:
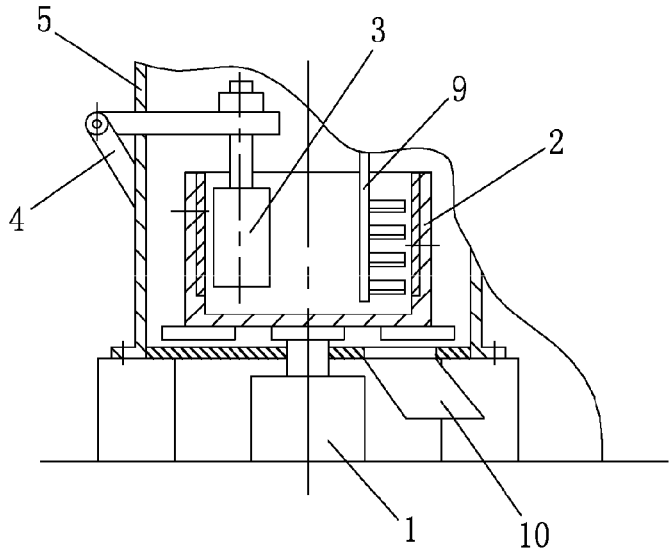
FIG. 8 is a sectional view of a second example structure of a grinding device of the invention.

FIG. 8 is a second example structure of a grinding device of the present invention. The vertical grinding barrel is cylindrical, and a grinding surface 6 of the inner lining thereof is of a vertical 90 degrees, and a material-shaving device having guiding plates 13 is used, so that the grinded materials are discharged from the vertical grinding barrel and then discharged off via a material outlet 10.

Figure 9:
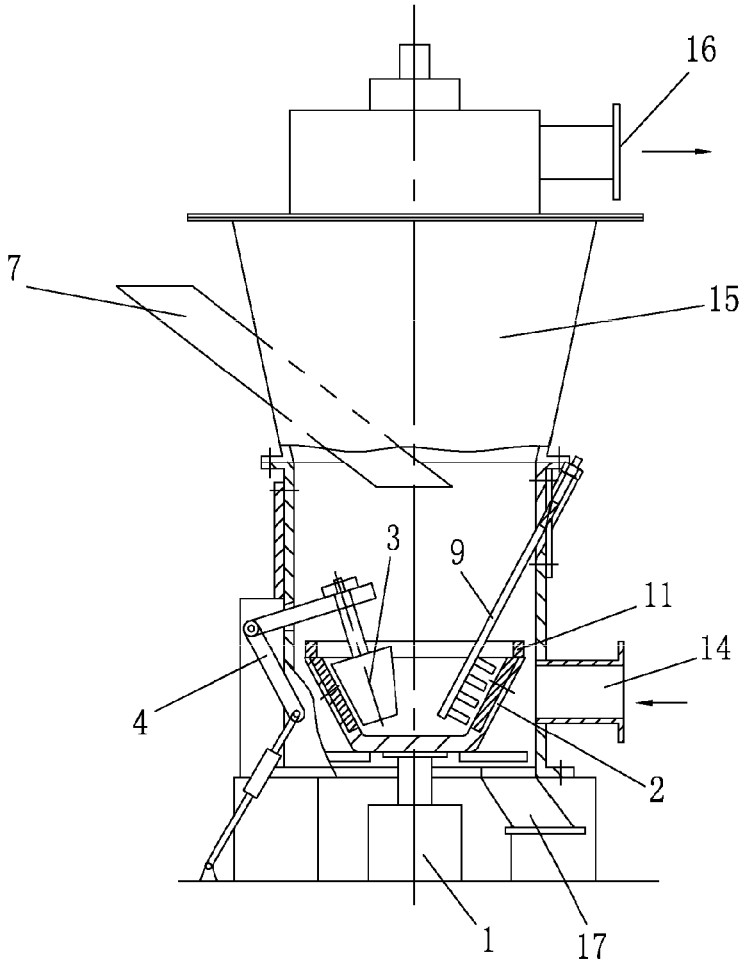
FIG. 9 is a structural schematic diagram in which the grinding device of the invention is applied to a vertical grinder.

FIG. 9 is a structural schematic diagram in which the grinding device of the present invention is applied to a vertical grinder. The material-shaving device 9 may a material-shaving device having a comb-like shape 12 or a material-shaving device having guiding plates 13. The blocking ring 11 illustrated in FIG. 9 is circular. As illustrated in FIG. 9, the materials enter the vertical grinding barrel via the material inlet 7, and are discharged from the vertical grinding barrel after being grinded, pressure air is taken in via an air inlet 14, fine powder is discharged from the outlet 16 via a cyclone type separator 15, and coarse particles and slag are discharged from a slag outlet 17.

The present invention has other modifications besides the above grinding devices. Any modification based on the technical solution of the present invention shall fall within the protection scope of the present invention.

What is claimed is:

1. A grinding device of a vertical grinder, comprising: a driving device (1); a vertical grinding barrel (2) which is driven by the driving device; a grinding roller (3); a pressure applying device (4) acting on the grinding roller (3), and a material-shaving device (9);

wherein the vertical grinding barrel (2) includes an upper opening;

wherein a running-in surface is composed of the roller surface of the grinding roller and a grinding surface (6) of the inner lining of the vertical grinding barrel;

wherein the grinding surface (6) of the inner lining of the vertical grinding barrel and the vertical line has an angular separation; and wherein the material-shaving device (9) includes features that are complementary to the angular separation between the inner lining and the vertical line, and is configured to loosen grinded materials attached to the inner lining and drive the grinded materials towards the upper opening.

2. The grinding device of the vertical grinder according to claim 1, wherein the angular separation between the grinding surface (6) of the inner lining of the vertical grinding barrel and the vertical line is of −5 to 5 degrees, and the material-shaving device include guiding plates (13) configured to complement the angular separation of −5 to 5 degrees.

3. The grinding device of the vertical grinder according to claim 1, wherein the angular separation between the grinding surface (6) of the inner lining of the vertical grinding barrel and the vertical line is of 5 to 40 degrees, and the material-shaving device includes a comb-like shape (12) configured to complement the angular separation of 5 to 40 degrees.

4. The grinding device of the vertical grinder according to any of claims 1 to 3, further comprising a blocking ring (11) disposed at an edge of the upper opening of the vertical grinding barrel, and configured to counter the material-shaving device and regulate discharge of the grinded material through the upper opening.

* * * * *